US005333686A

United States Patent [19]

Vaughan et al.

[11] Patent Number: 5,333,686

[45] Date of Patent: Aug. 2, 1994

[54] MEASURING WHILE DRILLING SYSTEM

[75] Inventors: Susanne F. Vaughan, Pflugerville, Tex.; Henry S. More, Los Altos, Calif.

[73] Assignee: Tensor, Inc., Austin, Tex.

[21] Appl. No.: 73,785

[22] Filed: Jun. 8, 1993

[51] Int. Cl.[5] ..... E21B 47/00

[52] U.S. Cl. ..... 166/250; 175/50; 367/85

[58] Field of Search ..... 166/250, 252, 369, 373, 166/381, 386, 383; 175/40, 48, 50, 317, 318; 367/83–85

[56] References Cited

U.S. PATENT DOCUMENTS 3,958,217 5/1976 Spinnler .
4,550,392 10/1985 Mamby .
4,825,421 4/1989 Jeter .
5,103,430 4/1992 Jetter et al. ..... 175/50 X

*Primary Examiner*—Thuy M. Bui
*Attorney, Agent, or Firm*—Cox & Smith Incorporated

[57] ABSTRACT

A measuring while drilling apparatus for use in the drilling of subterranean wells comprises a plurality of interconnected tubular housings which are insertable into and removable from a drill string by a wire line. A hollow plunger on the bottom of the apparatus is vertically shiftable with respect to a fixed diameter orifice disposed in the path of the drilling fluid flow. Fluid pressure forces derived from the drilling fluid effect the movement of the plunger forward and away from the orifice to create pressure pulses which are transmittable through the drilling fluid to the surface. Sensors provided in the housings generate signals, which are converted by a downhole controller, to effect the sequential generation of the positive pressure pulses to be indicated at the surface of the well by a digital readout of the outputs of the various sensors carried in the tubular housings.

24 Claims, 6 Drawing Sheets

MEASURING WHILE DRILLING SYSTEM

FIELD OF THE INVENTION

The invention relates in general to a measuring while drilling (MWD) system, in particular a telemetry system using a pulser that communicates the downhole environmental conditions and borehole directional information to the surface of an operating drilling wellhole. In greater particularity the invention relates to such a system that accomplishes positive pulse signaling by a pulser that momentarily restricts the drilling fluid flow in the drill string.

BACKGROUND OF THE INVENTION

The invention relates to the field of telemetry systems for transmitting information from the bottom of a well hole to the surface. In particular, this invention relates to the field of mud pulse telemetry where information detected down the well is transmitted to the surface by pressure pulses created in the circulating drilling fluid stream or mud stream in the drill string.

The desirability and effectiveness of well logging systems where information is sensed in the well hole and transmitted to the surface through mud pulse telemetry has long been recognized. Systems of this type, i.e., mud pulse telemetry system, provide the driller at the surface with means for quickly determining various kinds of information down the well, most particularly information about the location and direction of the drill string at the bottom of the well.

Because of the tremendous investment already made in drill pipe and drill collars, it is highly desirable that the borehole telemetry system be compatible with existing drilling equipment and require minimum or no modification to the drill pipe and drill collars. Mud pulse telemetry is known to offer an effective solution since it does not rely upon electric wires extending to the surface, or other mechanisms which may necessitate modification to existing hardware. Mud pulse telemetry propagates signals through the mud flow in the drill string to the surface at the speed of sound, thereby providing a very fast communication link between the drill bit and the surface. Mud pulse telemetry is usually in the form of a valve located in the vicinity of the drilling bit, which intermittently restricts the flow of mud within the drill string. The telemetry system may be lowered on a wireline located within the drill string, but is usually formed as an integral part of a special drill collar inserted into the drill string near the drilling bit.

A continuous column of mud is circulating within the drill string from the surface of the well to the drill bit at the bottom of the wall during normal drilling operations. The basic operational concept of mud pulse telemetry is to intermittently restrict the flow of mud as it passes through the downhole telemetry valve, thereby creating a pressure pulse in the mud stream that travels to the surface of the well at the speed of sound through the drilling mud. The information sensed in the vicinity of the drilling bit, which is to be transmitted to the surface, is encoded into a digital format and that digital formatted signal is used to intermittently actuate the telemetry valve which restricts the mud flow in the drill string, thereby transmitting pulses to the well surface. The pulses are detected at the surface and transformed into electrical or other signals which can be decoded and processed to reveal transmitted information. In a typical oil or gas well drilling mud is circulated through the interior of the drill pipe at flow rates of about 100 to 1200 gallons per minute. The mud pulse telemetry system must operate to partially restrict this flow, therefore the system must control large amounts of energy. The telemetry valve must operate quickly to create a pressure pulse in this high pressure environment to intermittently restrict the flow of mud. This restriction must be sufficient to create a pressure rise in the flow stream that will be detectable at the surface of the well. At the typically high flow rates of mud, considerable force and energy are required to actuate the telemetry valve in the manner necessary to create the desired pressure pulses.

A telemetry system which is capable of performing the desired function with a small amount of control energy is extremely desirable. Such a system should lend itself to size reduction and/or miniaturization that can be easily packaged within the confines of conventional drill pipe segment or drill collar. Furthermore, if input power requirements are low enough, downhole power sources such as high temperature batteries can be used to power the telemetry system.

SUMMARY OF THE INVENTION

The present invention is a positive pulse measuring while drilling system, with the downhole telemetry valve at the downhole end of a pulser, instead of pointing upward facing the pressurized drilling fluid or mud flow. The present invention is powered and controlled by a downhole high temperature battery pack and a microprocessor based controller. The battery pack, controller and all well logging instrumentation may be contained within the drill collar in the vicinity of the drilling bit, or in the bottom segment of the drill string. The controller provides a means to command and control all aspects of well-logging telemetry including, but not limited to, drill bit directional sensing and measurement of environmental conditions of the borehole. Also, the controller will provide a means for encoding those directional sensing and measurements into a digital format for transmission to the surface.

The pulse signal is generated in the mud flow in the drill string, not the return stream of mud flow around the drill string, or annulus. The system uses a pilot valve to actuate the main valve, and uses the energy of the mud flow to activate the pulser. The movements of the pilot valve are in response to encoded digital signals produced by environmental and directional sensors. The main valve momentarily restricts the mud flow in the drill string, thereby pulsating the mud in the drill string and up to the surface. This configuration of the present invention allows for measuring while drilling and transporting measurement signals uphole to awaiting interpretive surface equipment.

The mud signal propagation is accomplished by the main valve's downhole end moving downwardly into an orifice formed in the downhole end of a sleeve defining a passage for the downward flow of mud. Once that orifice area is reduced by the valve downhole end, momentarily restricting the mud flow, a pressure increase in the mud flow results. When the main valve retracts upwardly, the mud flow area increases and the pressure in the mud flow is returned to normal.

The orifice sleeve may be welded to a mule shoe sleeve. The mule shoe sleeve is utilized to orient and seat the pulser in correct angular alignment with the drill collar. The pulser is contained within a series of interconnected tubular housings. The directional sensors are fixedly mounted in the upper portion of the interconnected tubular housings. The lowermost housing defines a shaped slot open at its lower end which cooperates with a key on the mule show sleeve to angularly orient the directional sensors with the drill axis.

A plurality of vertically spaced centralizing stabilizers are mounted in a drill collar, or a tubular drill string segment connected to the drill collar, between the bore of the drill collar or tubular drill string segment and the periphery of the plurality of serially connected tubular housings. A hollow central plug projects downwardly out of the downhole end of the lowermost tubular housing and is axially shiftable relative to the downhole end of the lowermost housing between a first position axially spaced from the orifice sleeve and a second position adjacent to the orifice sleeve. A tubular shaft is secured at one end to the plug and extends upwardly through the lowermost tubular housing. An annular piston is formed around the top end of the tubular shaft, the piston having a downhole facing surface and an uphole facing surface.

A radial port is provided in the lower tubular housing for supplying pressurized drilling mud to the piston's downhole facing surface. A compression spring engages the uphole facing end surface of the annular piston to bias the piston and central hollow plug downwardly. A screened mud intake port in the tubular housing is provided for supplying pressurized drill mud to the uphole facing end surface of the annular piston and combines with the spring bias to move the annular piston and central hollow plug downwardly to the second position.

A pilot valve is mounted for movement between an opened and closed position relative to the mud flow from the mud intake port for controlling the flow of pressurized drilling mud to the upwardly facing end surface of the annular piston. The pilot valve is operated by a pair of solenoids that provide the required movement of the pilot valve between it's opened and closed position. The solenoids are in turn operated by a battery powered controller located in the upper portions of the interconnected tubular housings. A plurality of sensors in the upper portion of the interconnected tubular housings provide signals to the controller representing environmental, directional and core information conditions, hereinafter collectively referred to as environmental drilling conditions, which are to be transmitted to the surface.

A differential pressure detection diaphragm flow switch is positioned relative to the piston head and the pilot valve in a mud flow chamber formed above the uphole facing surface of the piston. This switch will sense both when mud is flowing and when mud flow has ceased in the mud flow chamber by measuring the differential pressure across the diaphragm. This differential pressure provides movement of the contacts of the flow switch, indicating to the controller that the diaphragm is sensing a pressure differential. This indication represents mud flowing through the screened mud intake port to the mud flow chamber surrounding the uphole facing surface of the main piston. When mud flow ceases in the mud chamber, the differential pressure diaphragm will indicate to the controller by movement of the contacts of the flow switch that the mud flow has ceased.

The pilot valve is positioned in the uphole end of the mud chamber, in line with a mud flow passage, thereby controlling the flow of mud to the upwardly facing end of the piston. This valve has two positions: open, pressurized mud flows past the valve into the mud flow chamber; and closed, the mud is prevented from flowing into the mud flow chamber. The main compression spring alone will not move the piston and plug downwardly. The pressurized drilling mud applied to the uphole facing end surface of the piston will combine with the spring bias to move the piston and plug downwardly to its second position relative to the orifice.

Once pressure decreases on the uphole side of the hollow plug, due to the cycling of the pilot valve, the pressurized mud on the downhole face of the piston begins to force the hollow plug upwardly. As mentioned, the top portion of one of the lower sections of the lower tubular housing has a radial port for supplying pressurized drilling mud to the piston's downhole facing surface. This force pressing upwardly on the piston's downhole facing surface will add upward pressure to the piston head, sufficient to urge the annular piston and the hollow central plug upwardly to the first position axially spaced from the orifice.

To minimize the force required to shift the pilot valve, the pilot valve, its operating shaft, and the two solenoids which are successively connected to the operating shaft, are all disposed within a separate chamber which is filled with oil. The pressure of the oil around these elements is maintained equal to the surrounding pressure of the mud flow through the incorporation of flexible diaphragms or membranes in the wall of the oil chamber. Thus, the movement of the pilot valve to its open position can be accomplished with a minimum of electrical energy supplied to the solenoids and can be returned to its closed position by a weak spring. The pressure equalization of the pilot valve assures a long life for the downhole batteries.

The present invention utilizes a telemetry program stored within the memory portion of the controller that provides the instructions for the command and control function for the pulser. The best mode of operation of the pulser utilizing the stored program can best be understood by presetting initial conditions for positive pulse transmission while drilling. In the initial condition, there is no mud flow and the pressure in the mud flow chamber is the same as in the flow sensor chamber. The pilot valve is in its closed position. The main spring has forced the main valve end into the downmost position in the main valve orifice. The flow switch is in the no-flow state, indicating no mud flow.

Pumping begins with mud flow being forced thru the main valve orifice with the main valve end extended into the orifice. This creates a lower pressure in the mud flow below the orifice. The hollow shaft opening provides a conduit for reducing the pressure in the mud flow chamber. This reduced pressure results in a condition where the pressure in the flow sensor chamber is greater than the pressure in the mud flow chamber. This pressure differential forces the plunger shaft to move downward and therefore changes the state of the flow switch. The same pressure differential causes the main valve end to retract upward and out of the orifice until it reaches an equilibrium position. The controller having sensed mud flow from the flow switch and knowing the preconditions of the main valve signals the first solenoid to energize thereby pulling back the pilot valve's forward end from its orifice. Approximately 80 milliseconds later the controller energizes the second solenoid to hold the retracted pilot valve's end away from the pilot valve orifice. At this time, the first solenoid is de-energized and the second solenoid holds the pilot valve's shaft in a retracted position with reduced electrical energy. The pressurized mud begins to flow through the pilot valve's orifice into the mud chamber, engaging the piston head of the main valve and producing a downward pressure. A portion of this mud flow traverses the center core of the main valve and exits the lower end into the mud stream of the drill collar. The added pressure upon the piston head combined with the force of the main spring urges the piston downwardly, pushing the main valve downwardly until it's forward end is adjacent the orifice, thereby reducing the orifice area and creating a pressure increase in the drilling mud, thus producing a positive pulse.

The controller will continue alternating the pilot valve between open and closed positions causing the main valve to create positive mud pulses in the mud flow until all of the desired information gathered from the plurality of sensors is transmitted to the surface by way of pulses in the mud flow pressure.

A complete appreciation for the invention and many of the advantages thereof will be readily perceived by reference to the following detailed description, taken in conjunction with the following drawings.

BRIEF DESCRIPTION OF DRAWINGS

FIGS. 1A–1D illustrate the positions of the components of the tool when the main mud flow restricting valve is in its lowermost, operating position.

DETAILED DESCRIPTION OF THE PREFERRED EMBODIMENT

Figure 1A:
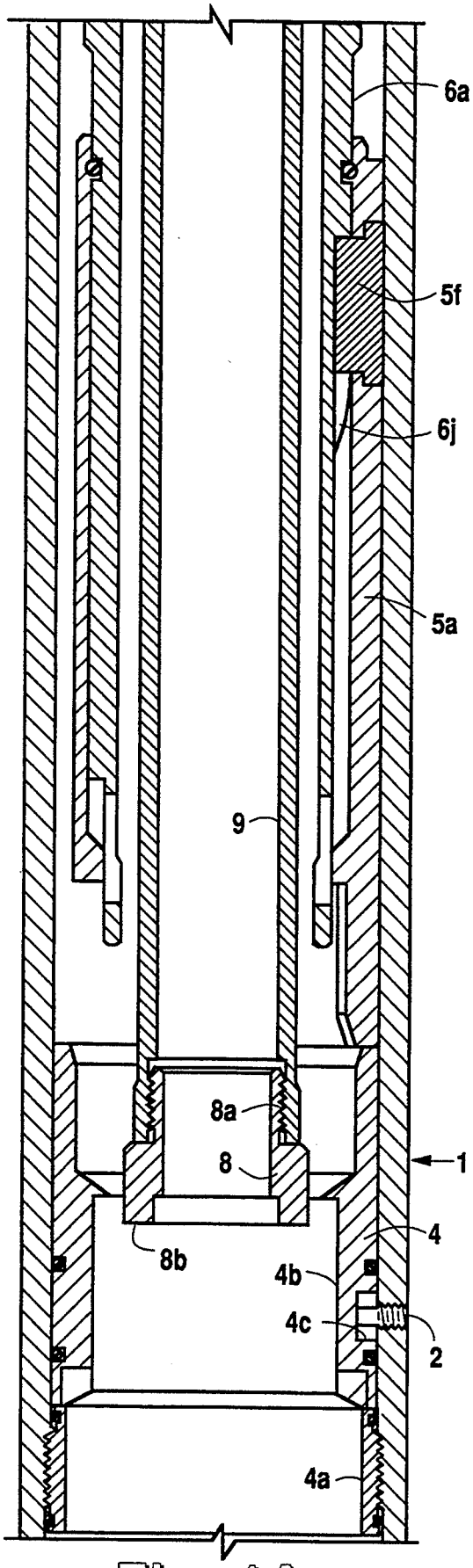
FIGS. 1A–1G collectively constitute a vertical sectional view of a measuring while drilling tool embodying this invention with FIG. 1A being the lower portion of such tool and FIG. 1G being the uppermost portion of such tool.
Figure 2A:
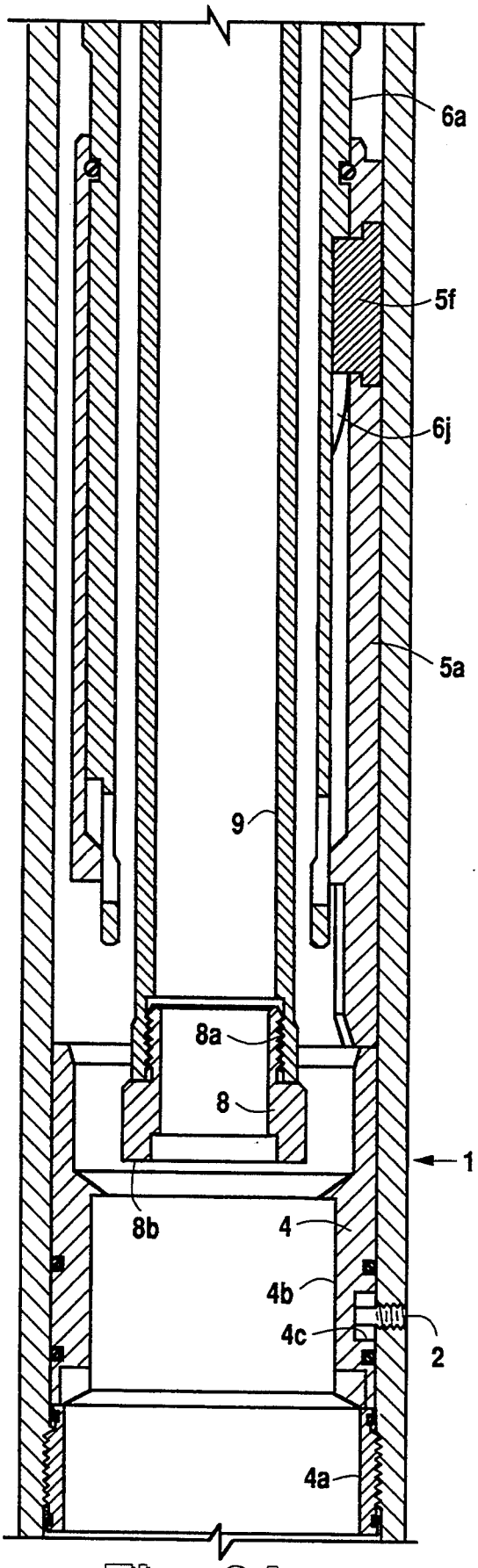
FIGS. 2A–2D are views respectively similar to FIGS. 1A–1D but showing the components of the tool in the positions occupied when the mud flow constricting valve is in its inoperative position.

The drawings schematically illustrate a measuring while drilling (MWD) tool embodying this invention. As is conventional, drill collar 1, formed of a non-magnetic metal, is positioned downhole and has connected to its lower end 1*a* a conventional drilling tool (not shown). Such drill collar 1 is threadably connected at its upper end to the lower end of a tubular drill string (not shown), which extends from the drill collar to the well surface. Alternatively, a special tubular segment, formed of non-magnetic material, either forms an extension of a conventional drill collar or is incorporated in the lower end of the drill string, preferably immediately above the drill collar. The drill collar 1, or the alternative tubular segment, houses a majority of the elements embodying this invention, and, for reference convenience, either structure will be referred to as a tubular drill string segment 1.

An orifice sleeve 4 is clamped in position within the lower end of the tubular drill string segment 1 by a threaded retaining sleeve or jam nut 4*a* which is threadably engaged with threads provided in the interior of the lower end of the tubular drill string segment 1. Orifice sleeve 4 defines a cylindrical passage 4*b* through which a pressurized drilling fluid, such as drilling mud, flows to actuate the drilling tool. The pressurized drilling fluid is supplied from the well surface through the drill string segment 1. After exhausting from the drill tool, the drilling fluid flows upwardly around the exterior of the drilling string segment 1 to the well surface, carrying with it the formation particles released by the action of the drilling tool, where the formation particles produced by the drilling tool are conventionally removed from the drilling mud.

The apparatus comprising the present invention constitutes a plurality of serially interconnected housings 6*a*, 6*b*, 6*c*, 6*d*, 6*e*, 6*f*, 6*g*, and 6*h* as is shown in FIGS. 1A–1G. A plurality of centralizers 5*a*, 5*b*, 5*c* and 5*d* are conventionally mounted within the tubular drill string segment 1 in vertically spaced relation, to position the interconnected tubular housings 6*a*–6*h* concentrically within the tubular drill string segment 1, thus defining an annular passage around the exterior of the interconnected housings for the downward flow of the pressurized drilling fluid.

That pressurized drilling fluid not only activates the drilling bit but also acts as a communication conduit for a plurality of sensors S, to be described, that provide environmental information to a controller C for transmission to the surface. The individual types of sensors that provide environmental information are well known in the art. When location sensors are used, they must all be specifically aligned with the axis of the drilling tool. Such alignment is accomplished by utilizing a mule shoe centralizer 5*a* as the lowermost centralizing unit. Mule shoe centralizer 5*a* may be formed as an integral part of orifice sleeve 4, or welded thereto. Mule shoe centralizer 5*a* incorporates a inwardly projecting radial lug or key 5*f*, which cooperates with a triangular slot 6*j* formed in the lowermost interconnected tubular housing 6*a* to effect alignment of the environmental sensors S within the interconnected housings with the axis of the drilling tool. The angular position of key 5*f* is fixed by a set screw 2 traversing the wall of tubular drill string segment 1 and engaging an axis slot 4*c* in orifice sleeve 4. Thus, the mule shoe centralizer 5*a* is aligned by orifice sleeve 4 and the tubular housing 6*a* is aligned by the orifice sleeve 4 with set screw 2.

Figure 1B:
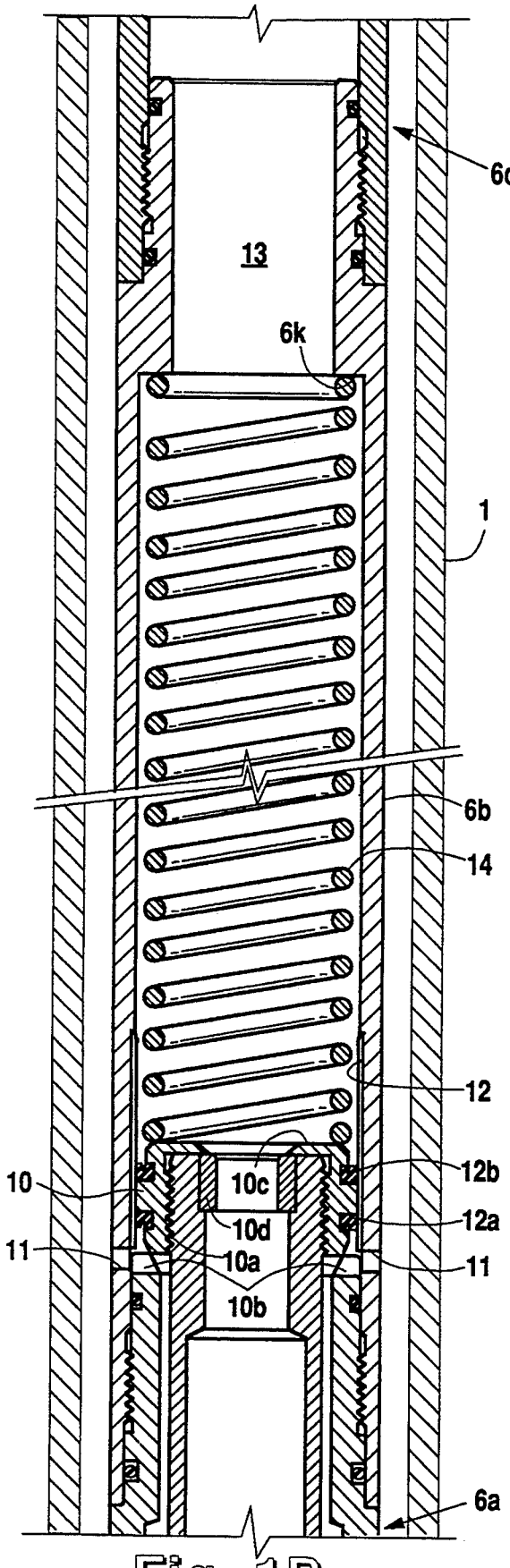
Figure 2B:
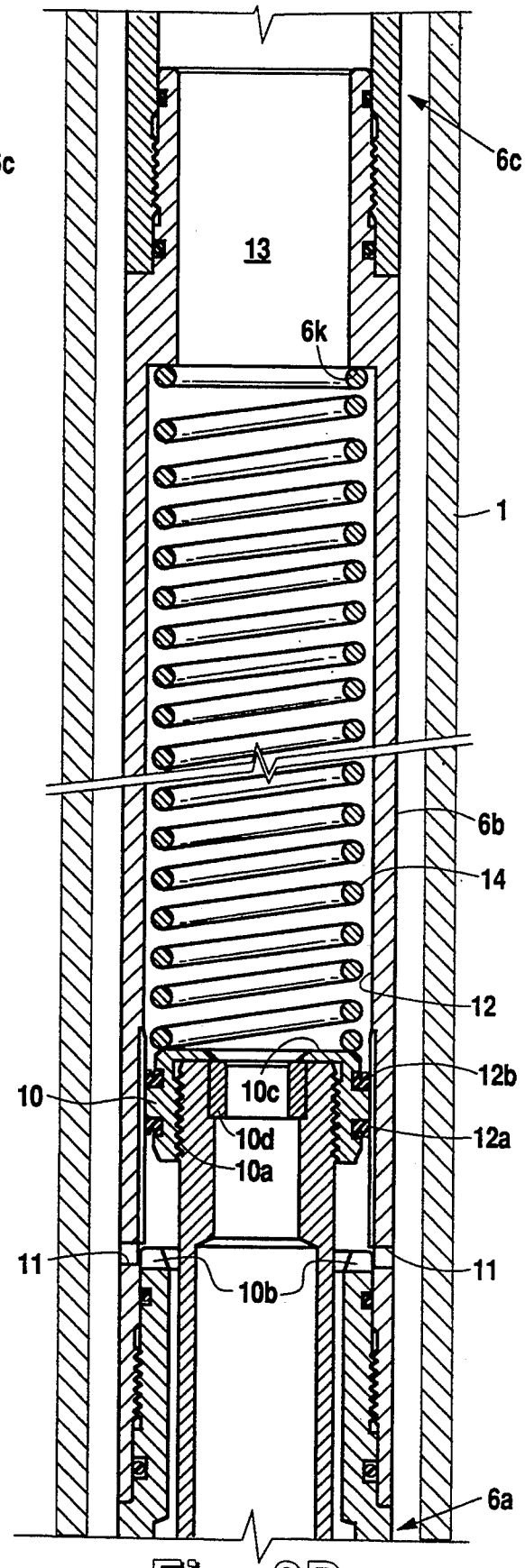

Communication of information to the well surface is accomplished by encoded signals producing pressure surges in the downward flow of the pressurized drilling fluid. Such pressure surge is accomplished by the axial movement of a hollow poppet or flow plug 8 moving downwardly into orifice 4*b* defined by orifice sleeve 4 and restricting the flow of pressurized mud, thereby increasing the pressure of the mud. Flow plug 8 threadably secured by threads 8*a* to the interior of an upwardly extending hollow shaft or plunger 9. The top end of plunger 9 (FIG. 1B) has an annular piston 10 threadably secured thereto by threads 10*a*. The cylindrical periphery of annular piston 10 has a seal 12*a* and a wiper ring 12*b* providing a sealing engagement with the bore of a cylindrical sleeve 12, which is mounted in the second interconnected tubular housing 6*b*. Piston 10 is shown in FIG. 1B in its lowermost operative position, wherein flow plug 8 is disposed within the orifice 4*b*. A bore diameter adjustment sleeve 10*d* is secured within the bore of annular piston 10 by the upwardly facing end 10*c* of annular piston 10.

That lowermost position of annular piston 10, and hence that of flow plug 8, is determined by the engagement of the downwardly facing annular surface 10*b* of annular piston 10 with the top edge of the lowermost tubular housing 6*a*. Annular piston 10 is biased to this lowermost position partially by a compression spring 14 and partially by the pressurized mud flow as will be explain, forthwith. Compression spring 14 is positioned between an internal shoulder 6k provided in the second interconnected tubular housing 6b and the upwardly facing annular surface 10c of annular piston 10. Upward movement of the annular piston 10 is limited by the compacting of the compression spring 14.

It should be noted that annular piston 10 is therefore movable within a mud flow chamber 13 defined within second interconnected tubular housing 6b and extending into the third interconnected tubular housing 6c. Immediately below the lowermost position of the downwardly facing annular surface 10b of the annular piston 10, one or more radial ports 11 are provided in the tubular housing 6b. These ports permit a portion of the pressurized drilling fluid to operate on the downwardly facing annular surface 10b of annular piston 10 and impact an upward bias to such piston. It should also be noted that the downwardly facing end surface 8b of the flow plug 8 is subjected to an upward fluid pressure force by the pressurized drilling mud flowing around it. The pressurized mud is also free to move upwardly through the hollow bore of the shaft or plunger 9 and to enter mud flow chamber 13 when no pressurized drilling mud is entering mud flow chamber 13 from the upwardly adjacent pilot valve mud flow chamber 15, to be described.

Pilot valve mud flow chamber 15, which is in the lower portion of the third inter-connected tubular housing 6c, is in communication with mud flow chamber 13 that extends upwardly from tubular housing 6c into tubular housing 6c. Housing 6c has a large slot 16 cut in the side wall of mud flow chamber 15, which is covered by a screen 18 secured by screws 18a to the periphery of tubular housing 6c. Pressurized drilling fluid can then pass through the screen 18 and into the chamber 15. A small diameter fluid passage 20 is defined by an internally projecting shoulder 22 formed in the lower portion of the third interconnected tubular housing 6c. A pilot valve sleeve 21 is mounted in small diameter passageway 20 and secured in place by the radial screw 18b.

Figure 1C:
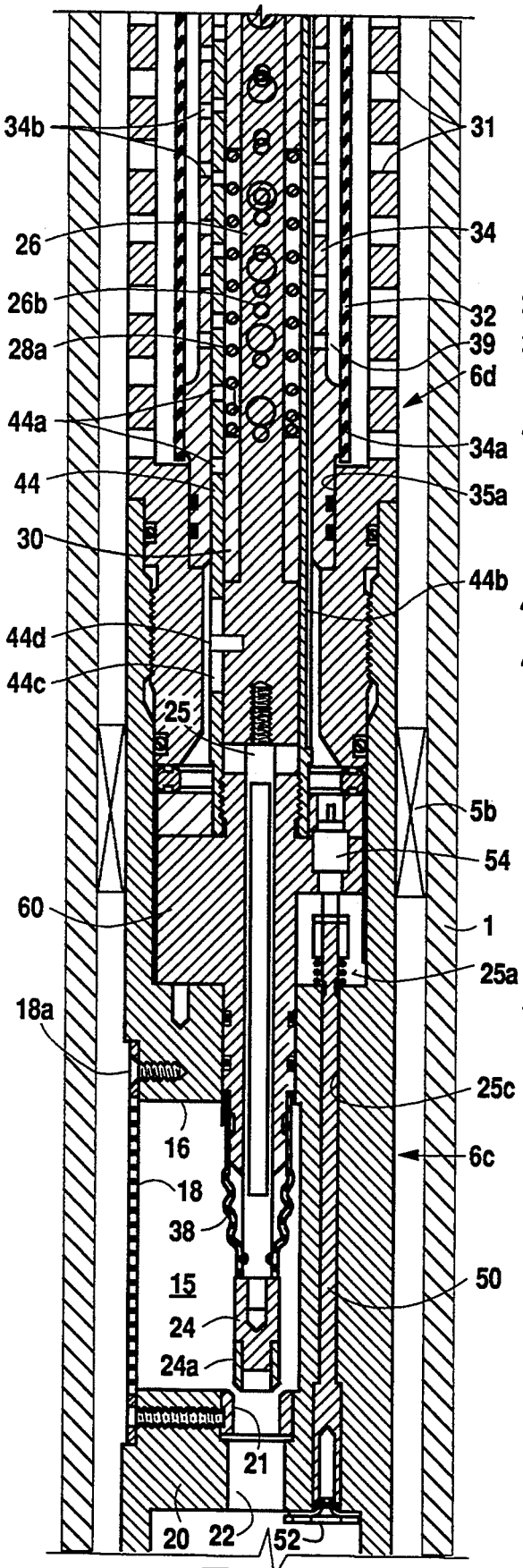
Figure 2C:
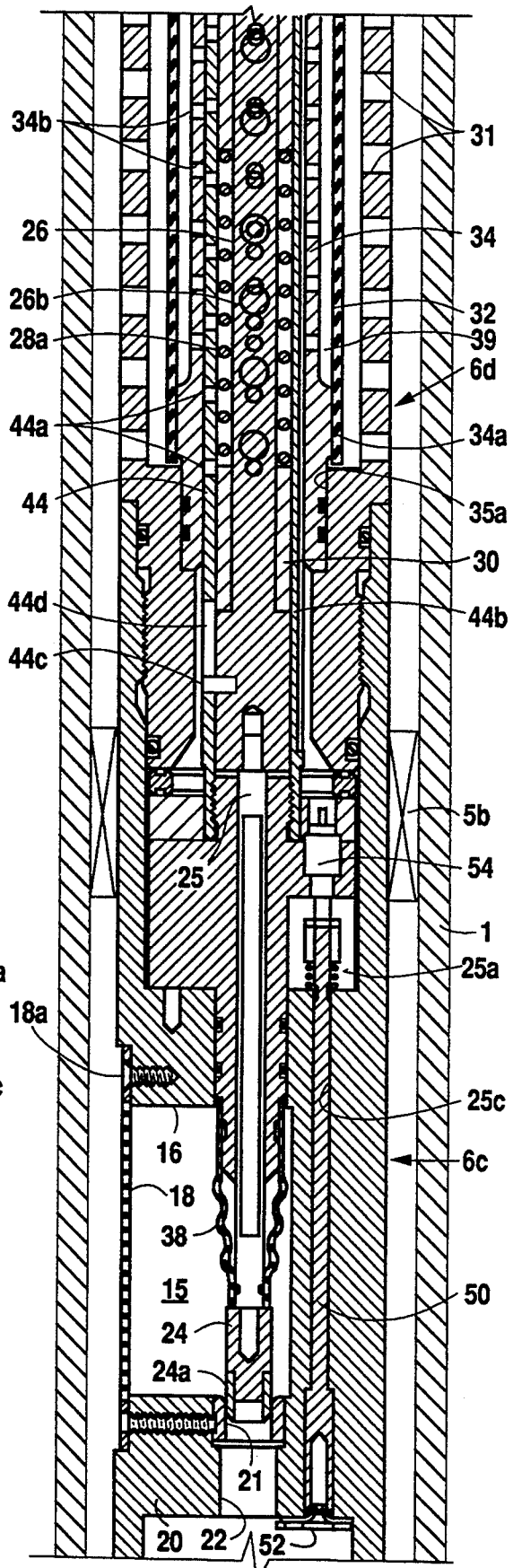
Figure 1D:
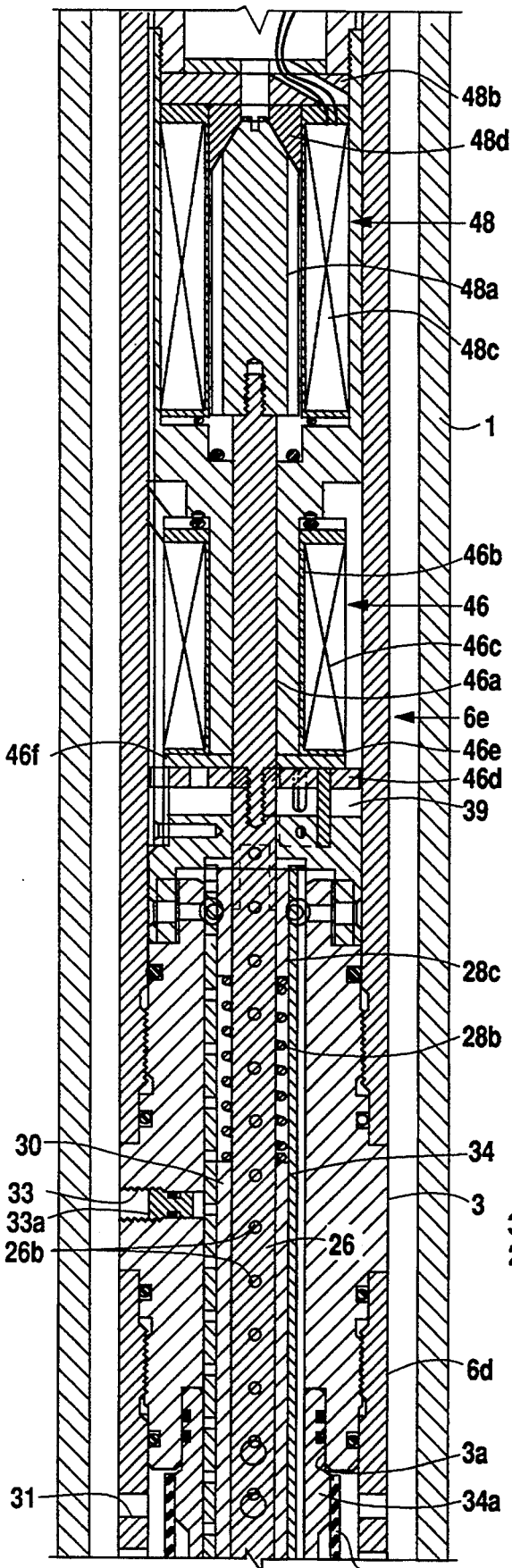
Figure 2D:
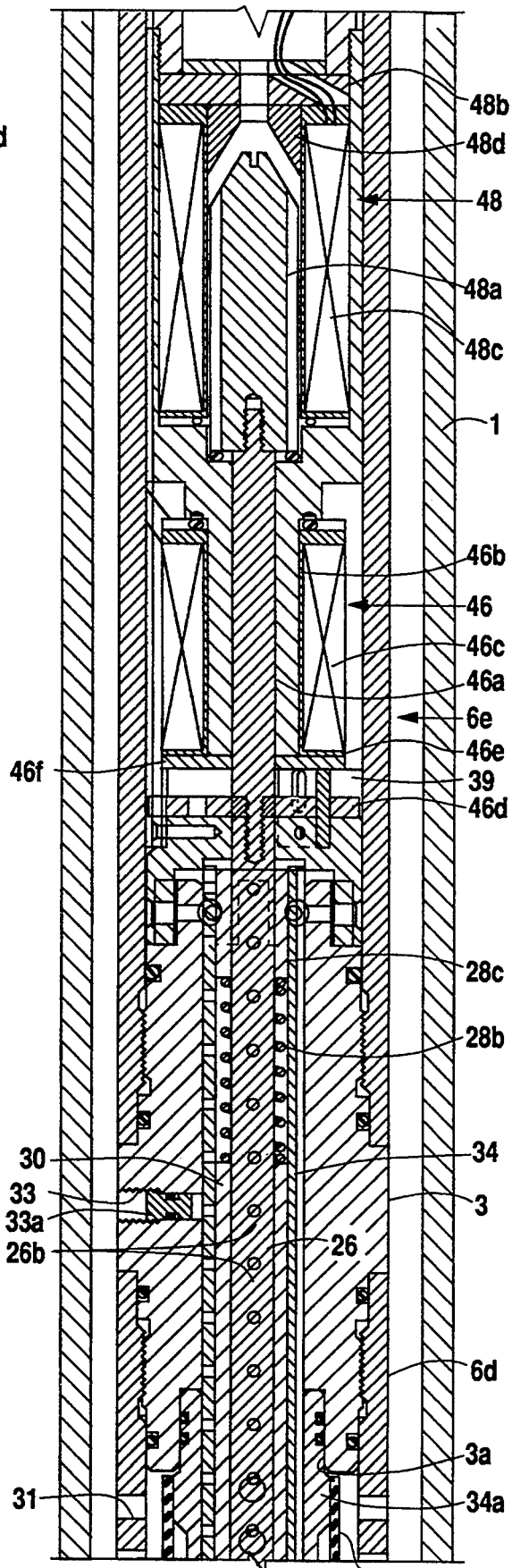
Figure 1E:
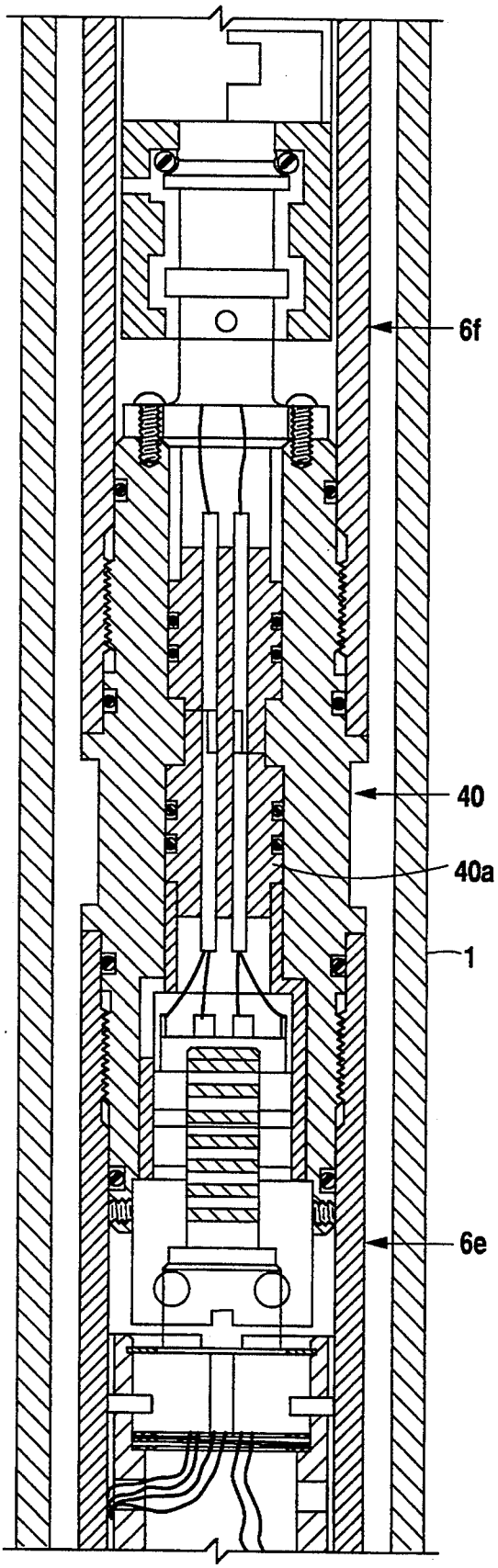
Figure 1F:
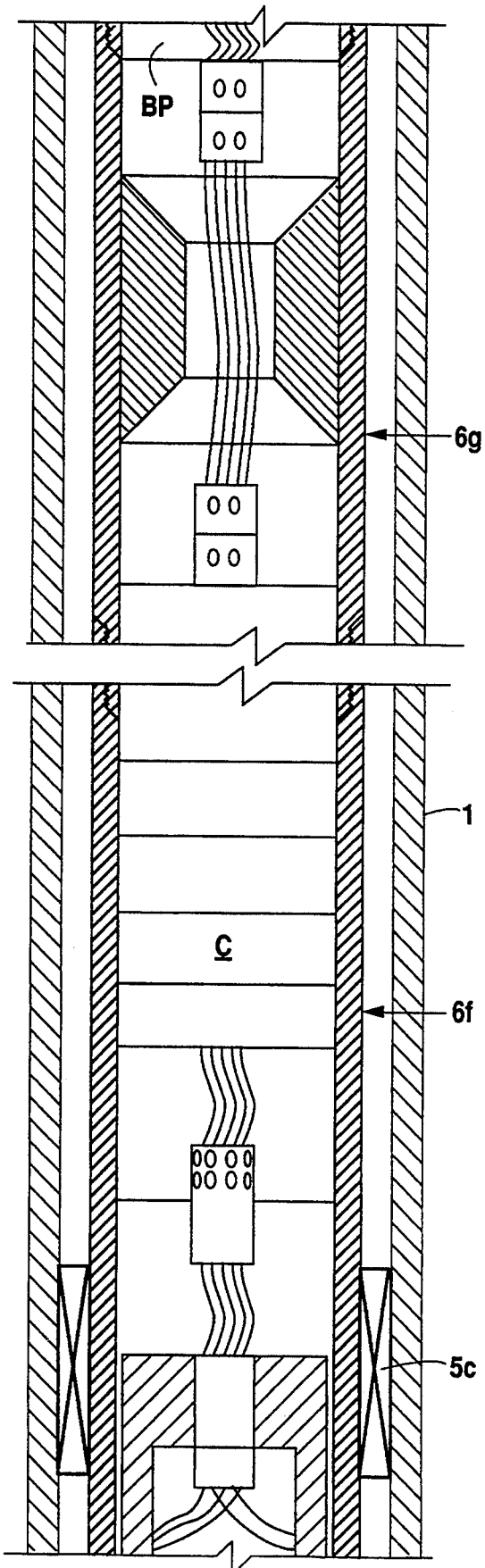
Figure 1G:
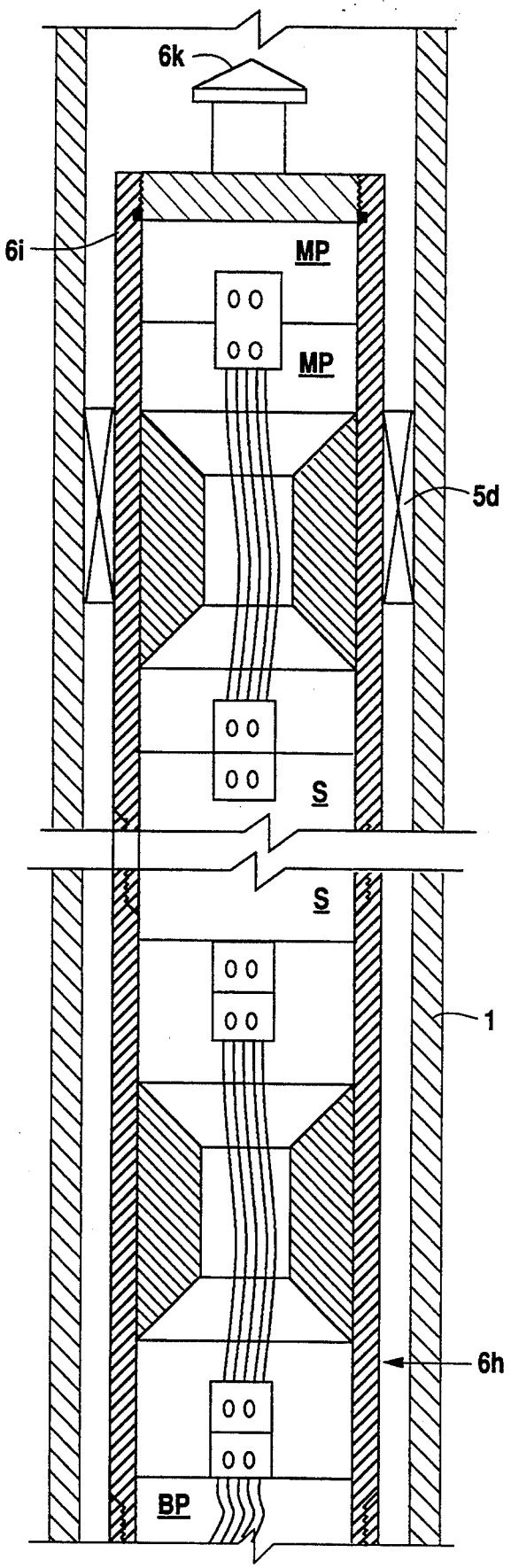

The passageway 20 defined by the pilot valve sleeve 21 is normally closed by a plunger element 24 which, as shown in FIG. 1C, is in close contact with the bore of the pilot valve sleeve 21. Plunger element 24 has a wear resistant sleeve 24a formed on its lower end which closely engages the bore of pilot valve sleeve 21. When plunger 24 is in close contact with passageway 20, pressurized mud flow into chamber 13 is reduced. When there is limited pressurized mud flow into chamber 13 there is not sufficient downwardly pressure exerted by compression spring 14 onto annular piston head 10 to retain plunger 9 and hence flow plug 8 in their most downward position. This decrease in pressure causes a differential pressure across flow plug 8, i.e. low pressure on the uphole facing end of flow plug 8 and high pressure on the downhole facing surface of flow plug 8. This action provides flow plug 8 with the necessary pressure condition to begin retracting from orifice 4b in orifice sleeve 4 until an equilibrium pressure position measured across flow plug 8 is achieved. As stated earlier, pressurized mud flow onto piston surface 10a via intake ports 11 continuously urges piston 10 upwardly compressing spring 14 in chamber 13. When plunger 24 is in the open position pressurized mud flows into chamber 13 onto piston surface 10c adding the needed partial pressure bias to the force of spring 14 to urge piston 10 downwardly, thereby moving plug 8 downward into orifice 4b.

Plunger 24 is threadably secured to the end of an elongated shaft 25 which extends upwardly through the third tubular housing 6c. Shaft 25 is threadably secured to a spring mounting shaft 26 which extends upwardly through tubular housing 6d, through nipple 3 into tubular housing 6e where it is connected to the actuating core 48a of a solenoid 48. A pair of light easily compressible springs 28a and 28b which surround shaft 26, are separated by a sleeve 30 which also slidable surrounds the shaft 26. Upper spring 28b abuts a spacer sleeve 28c which is secured in the hollow nipple 3.

As mentioned, the top end of the spring supporting shaft 26 is threadably secured to the bottom end of a solenoid shaft 46a. Solenoid shaft 46a is in turn threadably connected to the actuating core 48a of an actuating solenoid 48. When it is desired to move the plunger 24 upwardly out of closing engagement with the bore of valve element 21, the actuating solenoid 48 is energized by current supplied from a downhole battery pack BP (FIG. 1F) conventionally mounted in one of the additional interconnected tubular housings secured to the top end of the housing 6g. These same additional tubular housings may also mount the various sensors S (FIG. 16) for making the desired measurements.

The fourth interconnected tubular housing 6d is provided along the major portion of its length with a plurality of axially spaced ports 31 through which the drilling fluid may readily flow. The pressurized drilling mud flowing through the ports 31 acts upon a flexible tubular diaphragm or membrane 32 which is sealed to axially spaced shoulders 34a on a tubular diaphragm support sleeve 34. The opposite ends of support sleeve 34 are respectively sealably mounted within a cylindrical wall surface 35a of tubular housing 6d and a cylindrical recess 3a in the bottom of nipple 3.

While the pressurized drilling mud cannot enter the interior of the flexible diaphragm sleeve 32, the entire interior of the diaphragm sleeve 32, as well as the plunger shaft 25 and the spring mounting shaft 26 may be subjected to a pressure equal to the drilling mud pressure. This feature is sealed by appropriate seals which define a chamber 39 for oil which is fillable through an oil fill port 33 and closed by a plug 33a. The oil chamber 39 extends from the plunger 24 upwardly to the top end of the fifth tubular interconnected housing 6e which is sealed by a conventional pressure bulkhead 40a sealably mounted in a second nipple 40 connected in the tubular housing string which passes electrical leads required for electrical elements in the oil filled chamber 39 upwardly into an air or nitrogen filled chamber 41 defined by interconnected housings 6f, 6g, 6h and 6i.

To ensure that the plunger 24 is subjected to the same internal oil pressure as the mud pressure entering through the slot 15, a secondary flexible diaphragm or bellows 38 is secured between the top end of the plunger 24 and the bottom end of a guide block 60. The pressurized oil is distributed around and through holes 26b in the spring mounting shaft 26 and along the periphery of the plunger shaft 26. Such distribution of the pressurized oil is assisted by radial ports 34b formed in the membrane support sleeve 34 and by a plurality of radial ports 44a formed in an oil distributing sleeve 44 surrounding the spring 28a, the sleeve 28c and the upper spring 28b. The various holes and ports eliminate trapped pockets of air. As a result, only a light spring force is required at any time to effect the movement of the plunger 24 into its closed position with respect to the passage way through the valve sleeve 21, regardless of the fluid pressure of the drilling mud flow. To accommodate electrical wires coming from a differential pressure switch 54 to be later described, an axial slot 44*b* is provided in sleeve 44.

To prevent angular movements of the plunger 24, an axial slot 44*c* is provided in oil distributing sleeve 44. A dowel pin 44*d* traverses slot 44*c* and engages sleeve 25. This prevents twisting and tearing of bellows 38.

The successive interconnected tubular elements 6*f*, 6*g*, 16*h* and 6*i* provided above pressure bulkhead 44*a* do not contain oil. The oil is blocked by the seals shown in the drawings. A downhole driver circuit C (FIG. 1F) for the solenoids may be mounted in housings 6*f*. A battery pack BP may be conventionally mounted in housings 6*f* and 6*g* and a plurality of sensors S for measuring downhole environmental conditions and appropriate microprocessor based controller MP may be mounted in tubular housing 6*h*.

At the top end of tubular housing 6*i*, a retrieving plug 6*k* is sealably mounted in the top of the housing 6*i* and permits the entire string of interconnected tubular housings to be removed from the drill string by wireline when repair or adjustments are necessary.

Returning now to the solenoids, the actuating solenoid 48 is of conventional construction, including a ferrous core 48*a* mounted in a ferrous sleeve 48*b* around which a plurality of turns of wire 48*c* are mounted to provide, when energized, a magnetic force to pull the plunger 24 upwardly to a limiting position defined by a ferrous barrier element 48*d*. Since it is highly desirable to minimize the draining of electrical energy from the downhole batteries in order to actuate the solenoids, the driver or control circuit C includes a plurality of capacitors within which energy is stored and, when triggered by a signal received from the controller, effects the discharge of the stored energy into the solenoid coil 48*c*.

In a similar manner, the holding solenoid 46 includes the previously mentioned ferrous core 46*a* which is slidably mounted within a ferrous sleeve 46*b* around which an actuating coil 46*c* is wound. To maintain the pilot valve actuating shaft 26 in its upper position without expending substantial amounts of battery energy, a ferrous disc or clapper 46*d* is secured to the lower end of the core 46*a* and is brought into closely spaced relationship with a radial flange 46*e* of ferrous material formed on the bottom end of the ferrous sleeve 46*b*. A thin disc 46*f* of non-magnetic material is mounted adjacent to the ferrous flange 46*e*. Thus, the energization of holding solenoid 46 after the actuating solenoid 48 has been actuated, will bring the clapper 46*d* into closely spaced relationship with the ferrous flange 46*e* and will hold the clapper and the connected extension shaft 26*a* in the uppermost position with a minimal amount of energy drain from the downhole batteries. The purpose of the non-magnetic disc 46*f* is to make sure that the permanent magnetic attraction of the clapper 46*b* by the ferrous sleeve 46*b* and flange 46*e* will not continue to hold the actuating shaft 24 and the extension shaft 26 in their upper positions when the holding solenoid 46 is deenergized. The actuating solenoid 48 is, of course, deenergized immediately upon the energization of the holding solenoid 46.

The medial portion of the tubular housing 6*c* is additionally provided with an axially extending bore 25*c*. A plunger shaft 50 is mounted in the bore 25*c* and at its lower end is engagable by elastomeric diaphragm, held by a pressure plate 52, which is responsive to the differential pressure between that existing in the chamber 13 and the oil pressure existing within a flow switch chamber 25*a* defined between slide block 60 and the inner wall of housing 6*c*. Downward movement of the diaphragm in response to flow of drilling fluid causing reduced pressure in the chamber 13 will cause a downward movement of the plunger shaft 50, thereby actuating a flow sensor switch 54 in chamber 25*a*. Actuation of flow sensor switch 54 is transmitted by wires (not shown) to inform the controller C that mud flow has been established through the drill string. The controller C then takes over the control of the pilot valve 24 to move it upwardly from its closed position to permit pressurized drilling positive fluid to flow from chamber 15 into chamber 13 and thus effect downward displacement of the piston 10 with the resultant creation of fluid pressure pulses due to the partial closing of the orifice 4*b* defined by the orifice sleeve 4 as shown in FIG. 1*a*.

Modifications of this invention will be readily apparent to those skilled in the art and it is intended that all such modifications be encompassed within the scope of the appended claims.

We claim:

1. Apparatus for producing positive pressure pulses in the downward flow of pressurized drilling mud by momentarily restricting the mud flow contained in an operating well drill string, comprising, in combination:

a tubular drill string segment serially mounted in the drilling string at a downhole location in the vicinity of the drilling tool;

a plurality of serially connected, tubular housings insertable within said tubular drill string segment;

a plurality of vertically spaced centralizing means mounted in said tubular drill string segment between the bore of said tubular drill string segment and the periphery of said serially connected tubular housings, thereby defining an annular passage for downward flow of pressurized drilling mud around the exterior of said tubular housings;

an orifice sleeve secured within the lower portion of said tubular drill segment below the lowermost one of said tubular housings;

said orifice sleeve defining a passage for downward flow of the pressurized drilling mud;

a hollow central plug projecting downwardly out of the downhole end of said lowermost tubular housing and being axially shiftable relative to the downhole end of said lowermost housing between a first position axially spaced from said orifice sleeve and a second position adjacent said orifice sleeve and thereby momentarily restricting the drilling mud flow through said orifice sleeve to produce a pressure pulse detectable at the well head;

a tubular shaft secured at one end to said plug and extending upwardly through said lowermost tubular housing;

an annular piston formed on the top end of said tubular shaft;

said piston having a downhole facing surface and an uphole facing end surface;

means in one of the lower tubular housings defining a cylinder surface sealingly cooperable with the periphery of said annular piston;

a first radial port means in said lower tubular housing for supplying pressured drilling mud to said piston's downhole facing surface, thereby urging said annular piston and said hollow central plug upwardly to said first position;

a compression spring engaging said uphole facing end surface of said annular piston to bias said annular piston and said central hollow plug downwardly;

a mud intake port means in said tubular housings for supplying pressurized drilling mud to said uphole facing end surface of said annular piston to combine with said spring bias to move said annular piston and said central hollow plug downwardly to said second position, thereby momentarily restricting the flow of pressurized drilling mud to produce an upward fluid pressure pulse detectable at the well heat;

a valve means for controlling the flow of pressurized drilling mud from said mud intake port means to said upwardly facing end surface of said annular piston;

a battery powered controller in the upper portions of said tubular housing;

a plurality of sensors in said upper portion of said tubular housings for respectively providing signals to said controller representing environmental conditions of the downhole drilling string; and actuator means for said valve means receiving from said controller a positive pressure pulse command sequence for cycling said valve means between open and closed positions;

thereby producing a sequence of upward fluid pressure pulses detectable at the well head to transmit said well environmental conditions.

2. The apparatus defined in claim 1 wherein said hollow plug is detachably secured to said bottom end of said hollow shaft, thereby permitting selection of hollow plugs having differing diameters to accommodate changes in normal operating flow rates and densities of the drilling mud.

3. The apparatus defined in claim 1 wherein said valve means comprises a cylindrical passage between said mud intake port means and said uphole facing end surface of said tubular shaft;

a solid cylindrical plug axially moveable between an open position above said cylindrical passage and a closed position in engagement with said cylindrical passage;

an upwardly extending actuating shaft having its bottom and secured to said solid plug;

resilient means urging said actuating shaft downwardly to position said solid plug in said closed position in sealing engagement with said cylindrical passage;

said valve means further comprising solenoid means for moving said actuating shaft upwardly to position said solid plug in said open position relative to said cylindrical passage;

means including a diaphragm for enclosing said shaft and said solenoid means in a sealed chamber; and means for filling said sealed chamber with oil, whereby the fluid pressure in said sealed chamber is constantly equalized with said drilling mud pressure.

4. The apparatus defined in claim 3 wherein said solenoid means comprises a first solenoid energizable by said controller for moving said actuating shaft and solid plug upwardly to said open position relative to said cylindrical passage; and a second solenoid energizable by said controller for latching said shaft in said open position, thereby permitting said first solenoid to be deenergized.

5. Apparatus for producing positive pressure pulses in the downward flow of pressurized drilling mud by momentarily restricting the mud flow contained in an operating well drill string comprising, in combination;

a tubular drill string segment serially mounted in the drilling string at a downhole location in the vicinity of the drilling tool;

a plurality of serially connected, tubular housings insertable within said tubular drill string segment and defining an annular passage for downward flow of pressured drilling mud around the exterior of said tubular housings;

an orifice sleeve secured within the lower portion of said tubular drill string segment below the lowermost one of said tubular housings;

said orifice sleeve defining a first passage for downward flow of the pressurized drilling mud;

a hollow central plug projecting downwardly out of the downhole end of said lowermost tubular housing and being axially shiftable relative to the downhole end of said lowermost housing between a first position axially spaced from said orifice sleeve and a second position adjacent said orifice sleeve and thereby restricting the drilling mud flow area through said orifice sleeve;

a fluid chamber defined by said tubular housings above said plug;

a tubular shaft secured at its bottom end to said hollow plug end extending upwardly through said lowermost tubular housing into said fluid chamber;

an annular piston formed on the top end of said tubular shaft; said piston having a downhole facing surface and an uphole facing end surface;

means defining a cylinder surface in said fluid chamber sealingly cooperable with the periphery of said annular piston;

first radial port means in said lower tubular housings supplying pressured drilling mud to said downwardly facing end surface of said piston, thereby urging said annular piston and said hollow plug to said first position;

a second radial port means in said tubular housings;

a second fluid passage connecting said second radial port means to said fluid chamber;

said second fluid passage having a substantially smaller flow area than said orifice sleeve passage;

a solid shiftable plug cooperating with said second fluid passage to open or close same;

solenoid means for shifting said plug;

a battery powered controller in the upper portion of said tubular housings;

a plurality of sensors in said upper portion of said tubular housings respectively providing signals to said controller representing environmental conditions of the downhole drilling string; and means for operatively connecting said controller to said solenoid means to introduce small pulses of pressured drilling fluid to said fluid chamber to produce downward movements of said shaft and hollow plug to produce large pressure pulses in the pressurized drilling mud.

6. The apparatus defined in claim 5 wherein said hollow plug is detachably secured to said bottom end of said hollow shaft, thereby permitting selection of hollow plugs having differing diameters to accommodate changes in normal operating flow rates and densities of the drilling mud.

7. The apparatus of claim 5 further comprising:

means including a diaphragm for enclosing said solenoid means in a sealed chamber having the exterior of said diaphragm exposed to the pressured drilling mud; and means for filling said sealed chamber with oil, whereby the fluid pressure in the interior of said sealed chamber is equalized with said drilling mud pressure.

8. The apparatus defined in claim 5 wherein said solenoid means comprises a first solenoid for moving said shaft and cylindrical plug upwardly to an open position relative to said cylindrical passage; and a second solenoid energizable by said controller for latching said shaft in said open position, thereby permitting said first solenoid to be deenergized.

9. The apparatus of claim 5 further comprising resilient means opposing upward movement of said solid plug.

10. Apparatus for producing upwardly directed pressure pulses in drilling mud contained in an operating well drilling string comprising, in combination:

a tubular drill string segment serially mounted in the drilling string at a downhole location in the vicinity of the drilling tool;

a plurality of serially connected, tubular housings insertable within said tubular drill string segment;

a plurality of vertically spaced centralizing means mounted between the bore of said tubular drill string segment and the periphery of said serially connected tubular housings, thereby defining an annular passage for downward flow of pressured drilling mud around the exterior of said tubular housings;

an orifice sleeve secured within the lower portion of said tubular drill string segment below the lowermost one of said tubular housings;

said orifice sleeve defining a passage for downward flow of the pressured drilling mud;

a central plug projecting axially downwardly out of said lowermost tubular housing and being axially shiftable relative to said lowermost housing between a first position axially spaced from said orifice sleeve and a second position adjacent said orifice sleeve and thereby reducing the drilling mud flow area through said orifice sleeve;

a fluid chamber defined by said tubular housings above said plug;

a tubular shaft secured to said plug and extending upwardly through said lowermost tubular housing to said fluid chamber, whereby drilling mud is moved upwardly through said hollow central plug and said shaft to said fluid chamber;

an annular piston secured to the top end of said tubular shaft and having a downwardly facing end surface and an upwardly facing end surface;

means defining a cylinder surface in said fluid chamber sealingly cooperable with the periphery of said annular piston;

a compression spring engaging said upwardly facing end surface of said annular piston to bias said annular piston and said central hollow plug downwardly against the differential fluid pressure exerted by said pressured drilling mud flowing around said hollow plug;

first radial port means in said lower tubular housings supplying pressured drilling mud to said downwardly facing end surface of said piston, thereby urging said annular piston and said hollow plug to said first position;

second radial port means in said tubular housings for supplying pressured drilling mud to said fluid chamber and said upwardly facing end surface of said annular piston to combine with said spring bias to move said annular piston and said central hollow plug downwardly to said second piston; thereby constricting the flow of pressured drilling mud to produce an upward fluid pressure pulse detectable at the well head;

valve means controlling flow of pressured drilling fluid from said second port means to said upwardly facing end surface of said annular piston;

control means for cycling said valve means between open and closed positions;

thereby producing a series of positive pressure pulses in said drilling mud detectable at the well head; and said control means being responsive to environmental conditions adjacent to the drilling tool.

11. Telemetry apparatus for transmitting data to the surface during the drilling of a borehole by generating pressure pulses in a pressured drilling fluid in a drill string, the apparatus comprising:

flow reducing means adapted for mounting in a drill string segment through which the pressured drilling fluid flows;

said flow reducing means including means mounted in said drill string segment defining an orifice;

a tubular housing disposed in said drill string segment to define an annular passage for pressured drilling fluid;

a hollow plunger disposed in said tubular housing above said orifice and movable downwardly into said orifice to reduce flow of pressured drilling fluid and produce a pressure pulse in the drilling fluid detectable at the surface;

means in said tubular housing for limiting said downward movement of said plunger to position the bottom end thereof within said orifice, whereby a first upward force is exerted on said plunger;

means in said tubular housing defining a cylindrical fluid chamber above said orifice; a downwardly facing surface and an upwardly facing surface;

an annular piston on said plunger having a periphery sealingly engagable with said cylindrical fluid chamber; a downwardly facing surface and an upwardly facing surface;

first radial port means in said tubular housing disposed beneath said downwardly facing annular piston surface in all positions of said hollow plunger, whereby a second upward force is exerted on said hollow plunger;

second radial port means in said tubular housing;

means defining a fluid passage for pressured drilling fluid between said second radial port means and said fluid chamber above all positions of said annular piston;

a pilot valve mounted for movement between an open and a closed position relative to said fluid passage; thereby applying a third downwardly directed force to said plunger only when said pilot valve is in said open position; and said third force being greater than the sum of said first and second forces to move said plunger to its said downward limited position.

12. The apparatus defined in claim 11 further comprising a sleeve threadably secured to the exterior of the lower end of said hollow plunger, thereby permitting variation of the minimum flow area through said orifice by selection of sleeves of differing external diameters.

13. The apparatus of claim 11 further comprising a spring opposing upward movement of said plunger, thereby requiring a minimum pressure in said drilling fluid to elevate said plunger relative to said orifice.

14. The apparatus of claim 11 further comprising:

an actuating shaft secured to said pilot valve and extending upwardly therefrom;

solenoid means for shifting said actuating shaft upwardly to move said pilot valve to an open position relative to said fluid passage;

resilient means urging said shaft downwardly to position said pilot valve in a closed position relative to said fluid passage; and means in said drill string segment responsive to well environmental conditions for cyclically operating said solenoid.

15. The apparatus of claim 14 further comprising enclosure means sealably enclosing said shaft and said solenoid means to isolate same from drilling fluid in said drill string;

said enclosure means including a flexible wall; and means for filling said enclosure means with oil, thereby equalizing the fluid pressure on said shaft and solenoid means with the pressure of the drilling fluid.

16. The apparatus defined in claim 14 wherein said solenoid means comprises a first solenoid for shifting said actuating shaft upwardly to move said pilot valve to said open position and a second solenoid means for latching said shaft in said upward open position.

17. The apparatus defined in claim 14 further comprising:

a controller in said drill string segment controlling said solenoid means; and differential fluid pressure responsive switch means in said chamber for energizing said controller only when sufficient pressurized drilling fluid flow occurs.

18. The apparatus of claim 5 further comprising:

differential fluid pressure responsive switch means in said chamber for energizing said controller only when sufficient pressurized drilling fluid flow occurs.

19. The apparatus of claim 10 further comprising:

differential fluid pressure responsive switch means for energizing said control means only when sufficient pressurized drilling fluid flow occurs.

20. The apparatus of claim 4 wherein said second solenoid comprises a ferrous solenoid shaft operatively connected to said actuating shaft;

a generally cylindrical inner ferromagnetic sleeve surrounding said ferrous solenoid shaft;

a winding encircling a portion of said ferromagnetic sleeve;

an integral annular shoulder on the top end of said inner ferromagnetic sleeve;

a ferromagnetic outer sleeve surrounding said winding and abutting said annular shoulder to define a magnetic path for flux generated in said inner ferromagnetic sleeve by current in said winding;

a ferromagnetic disc secured to the bottom end of said solenoid shaft;

said ferromagnetic disc being normally spaced downwardly away from said ferromagnetic inner and outer sleeves by said resilient means; and whereby current flow through said coil holds said ferromagnetic disc in said upward position of said actuating shaft where said solid plug is in said open position.

21. The apparatus of claim 20 further comprising a thin, non-ferrous disc interposed between said ferromagnetic disc and the lower ends of said inner and outer ferromagnetic sleeves to release said solenoid shaft for downward movement to said closed position of said plug when said coil is deenergized.

22. The apparatus of claim 1 wherein the lowermost one of said centralizing means is secured to said drill string segment and provides a stop for downward movement of said serially connected tubular housings;

a fishing head provided on the top end of said serially connected tubular housings, thereby permitting removal of said tubular housings from the drilling string by wireline; and the top end of said lowermost tubular housing providing a stop for downward movement of said piston, thereby permitting withdrawal of said piston, said shaft and said hollow plug with said interconnected tubular housings.

23. The apparatus of claim 10 wherein the lowermost one of said centralizing means is secured to said drill string segment and provides a stop for downward movement of said serially connected tubular housings;

a fishing head provided on the top end of said serially connected tubular housings, thereby permitting removal of said tubular housings from the drilling string by wireline; and the top end of said lowermost tubular housing providing a stop for downward movement of said piston, thereby permitting withdrawal of said piston, said shaft and said hollow plug with said interconnected tubular housings.

24. The apparatus of claim 11 wherein the lowermost one of said centralizing means is secured to said drill string segment and provides a stop for downward movement of said tubular housing;

a fishing head provided on the top end of said tubular housing, thereby permitting removal of said tubular housing and said plunger from the drilling string by wireline.

* * * * *